United States Patent [19]

Goineau

[11] Patent Number: 4,864,701

[45] Date of Patent: Sep. 12, 1989

[54] METHOD OF FORMING SPUN-LIKE SYNTHETIC YARN

[75] Inventor: Andre M. Goineau, Spartanburg, S.C.

[73] Assignee: Milliken Research Corporation, Spartanburg, S.C.

[21] Appl. No.: 290,705

[22] Filed: Dec. 27, 1988

[51] Int. Cl.[4] ..... D02G 1/16; D02J 3/02

[52] U.S. Cl. ..... 28/220; 28/219

[58] Field of Search ..... 28/219, 220

[56] References Cited

U.S. PATENT DOCUMENTS 4,501,046 2/1985 Krenzer .

FOREIGN PATENT DOCUMENTS 1249492 11/1960 France ..... 28/219
77685 2/1962 France ..... 28/219
584800 11/1958 Italy ..... 28/219

*Primary Examiner*—Robert R. Mackey
*Attorney, Agent, or Firm*—Earle R. Marden; H. William Petry

[57] ABSTRACT

An apparatus and process to produce a spun-like synthetic yarn which employs a filament loop breaker which is periodically and automatically opened to break the vacuum pressure to allow lint collected therein to be released and collected.

3 Claims, 2 Drawing Sheets

METHOD OF FORMING SPUN-LIKE SYNTHETIC YARN

This is a division of application Ser. No. 161,584, filed Feb. 29, 1988, for AUTOMATIC LINT REMOVAL.

This invention relates to a yarn texturing process in wich an effect yarn forms loops around a core yarn and the loops are broken by a suitable loop breaking device to provide a synthetic yarn with a spun-like yarn appearance.

It is an object of the invention to provide a process and apparatus to provide a spun-like synthetic yarn in which the filament loop breaker is automatically and periodically cleaned of accumulated lint.

Other objects and advantages of the invention will become readily apparent as the specification proceeds to describe the invention with reference to the accompanying drawings, in which.

Figure 1:
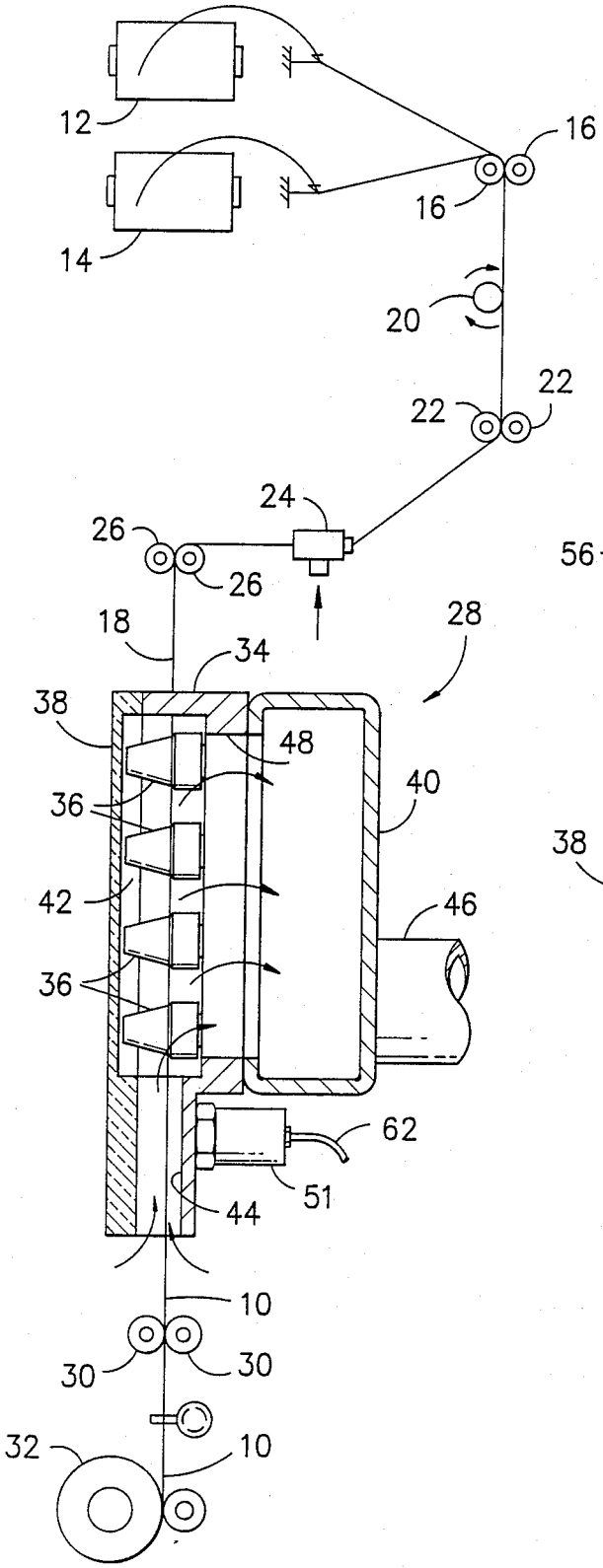
FIG. 1 is a schematic drawing of the process to manufacture a spun-like synthetic yarn.

Looking now to FIG. 1, the overall system is shown to produce a spun-like synthetic yarn 10. The starting yarns are 115/47 continuous filament polyester yarns from packages 12 and 14 which are merged in the nip of rolls 16. The yarn 18 exits the nip of rolls 16 at a speed of 276 meters/minute and is wrapped around the hot pin 20 prior to being drawn by the rolls 22 delivering yarn at a rate of 469 meters/minute. The hot pin 20 is, preferably, maintained at a temperature of about 150° C.

The drawn yarn 18 is then supplied to an air texturing jet 24 supplied with air at a pressure of about 150 p.s.i. wherein, due to the lower speed of the rolls 26 of 344 meters, one of the yarns of the merged yarn 18 wraps around the other of the yarns and is formed into a series of loops. The air textured yarn 18 is then supplied from the rolls 26 through the filament loop breaker 28 to the rolls 30. The spun-like synthetic yarn 10 is then supplied from the rolls 30 at a speed of 400 meters/minute to the take-up package 32 taking up yarn at a rate of 383 meters/minute.

The filament loop breaker 28 basically is a commercially available unit and consists of housing 34 having a plurality of rolls 36 therein around which the yarn 18 is wrapped, a door 38 to provide access to the rolls 36 for threadup and a vacuum source 40 to suck yarn and lint from the chamber 42 created by the breaking of the loops of the air textured yarn 18. The yarn exists through the channel 44 to the rolls 30.

Figure 2:
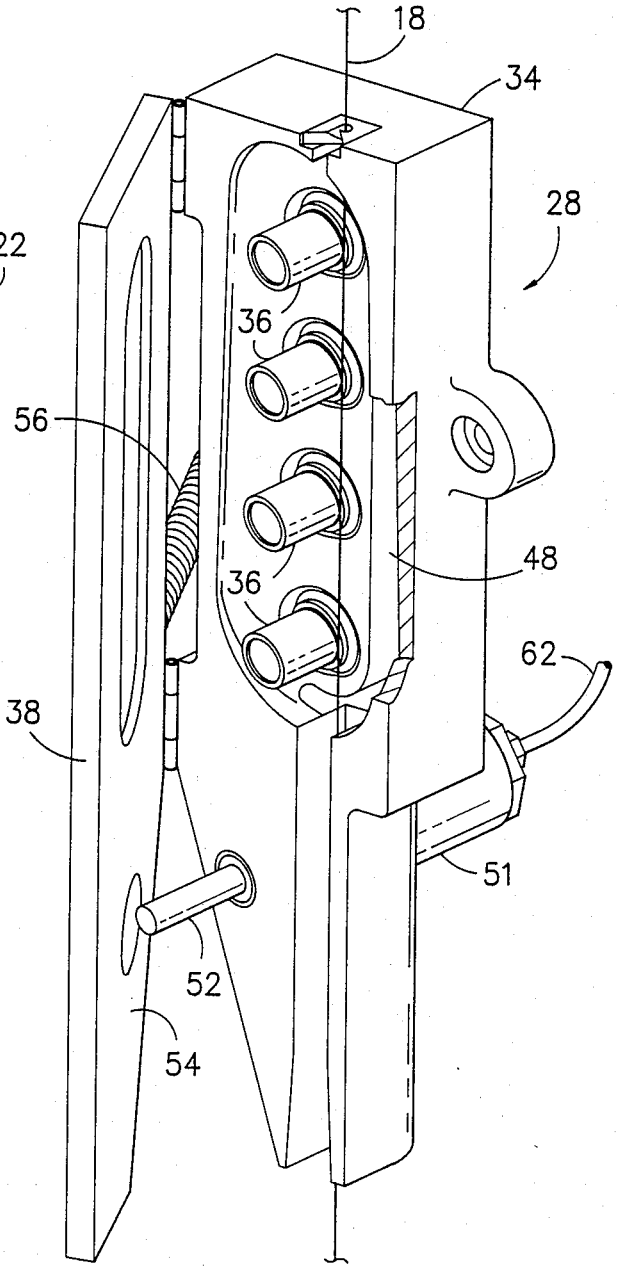
FIG. 2 is a blow-up schematic view of the filament loop breaker shown in FIG. 1.

It should be understood that FIGS. 1 and 2 represent only one position of a multiposition machine and the vacuum source 40 extends the length of the machine and is connected to a source of vacuum pressure through conduit 46 and collects lint through the slots 48 at each position.

In operation, it has been found that a lot of lint, rather than being pulled through the slot 48, tends to adhere to the rolls 36 and the inner surface of the housing 34 in the chamber 42. To alleviate this situation, a solenoid actuated air cylinder 51 has been mounted on the back of each unit 28 with its piston rod 52 projecting into and against the inner surface 54 of the door 38. Periodically the air cylinder 51 is pulsed to force the piston rod 52 outward so that it contacts the door surface 54 to open the door 38 against the action of the spring 56. Opening of the door 38 breaks the vacuum in the chamber 42 allowing the accumulated lint to fall from the surface adhered to and either fall through the channel 44 and/or be pulled through the slot 48 when the door 38 has been released by the piston rod 52. This periodic and automatic opening and closing of the door 38 prevents the accumulation of lint, etc. in the vacuum and loop breaking chamber 42.

Figure 3:
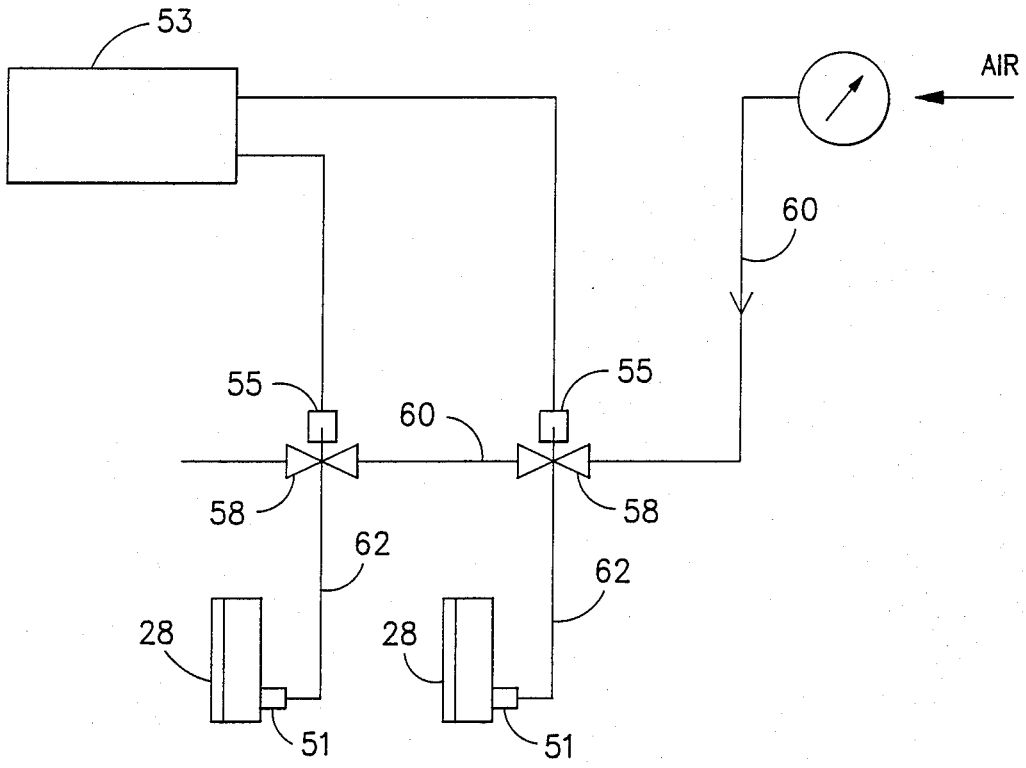
FIG. 3 is a simple schematic view of the control circuit for the automatic door opener of the filament loop breaker.

FIG. 3 schematically represents a simple control diagram showing that a programmable controller 53 is connected to a series of solenoids 55 to periodically, as programmed, activate the three-way valves 58 to supply air from the high pressure air line 60 into the conduit 62 to the desired air cylinder 51. The sequence and number of openings and closings of the doors 38 depends on the program of the computer 53.

It can be seen that the herein-disclosed filament loop breaker has been provided with an improvement which will automatically and periodically allow accumulated lint therein to be dissipated so that the loop breaker does not clog up and such lint, etc. does not end in the yarn 10 causing unwanted defects and/or effects therein.

Although the preferred embodiment has been described specifically, it is contemplated that changes may be made without departing from the scope or spirit of the invention and it is desired that the invention be limited only by the scope of the claims.

I claim:

1. The method of forming a spun-like synthetic yarn from continuous filament yarn comprising the steps of: merging and drawing at least two continuous filament yarns to form loops therein, texturing said yarns and causing said yarns to indiscriminately wrap around each other, supplying the textured and looped yarn into a vacuum chamber, breaking the loop in the textured yarn in the vacuum chamber whereby lint collects on the interior surfaces thereof, taking up the textured yarn after the loops have been broken and periodically and automatically breaking the vacuum pressure in the vacuum chamber to allow collected lint therein to be eliminated.

2. The method of claim 1 wherein the vacuum in the vacuum chamber is broken by applying a force against a door to the chamber and opening same.

3. The method of claim 2 wherein substantially all of the yarn produced is polyester.

* * * * *